United States Patent [19]

Haak et al.

[11] 4,250,794

[45] Feb. 17, 1981

[54] HIGH PRESSURE HYDRAULIC SYSTEM

[75] Inventors: Willard J. Haak, Peoria; Howard A. Marsden, Pekin; James P. Mueller, East Peoria, all of Ill.

[73] Assignee: Caterpillar Tractor Co., Peoria, Ill.

[21] Appl. No.: 892,370

[22] Filed: Mar. 31, 1978

[51] Int. Cl.[3] ..... F15B 13/042

[52] U.S. Cl. ..... 91/420; 91/421; 91/446; 91/453; 91/454

[58] Field of Search ..... 91/420, 421, 454, 433, 91/448, 461, 446, 453

[56] References Cited

U.S. PATENT DOCUMENTS

| | | | |
|---|---|---|---|
| 2,489,450 | 11/1949 | Crookston | 251/26 |
| 2,909,195 | 10/1959 | Keyt . | |
| 3,151,455 | 10/1964 | Tennis . | |
| 3,218,106 | 11/1965 | Junck et al. | 91/448 X |
| 3,433,131 | 3/1969 | Soyland et al. | 91/461 X |
| 3,608,435 | 9/1971 | Conabee et al. | 91/454 |
| 3,763,746 | 10/1973 | Walters | 91/433 |
| 3,800,670 | 4/1974 | Hufeld et al. | 91/420 |
| 3,874,269 | 4/1975 | Walters | 91/433 |
| 3,972,267 | 8/1976 | Haak et al. | 91/445 |
| 4,006,663 | 2/1977 | Baatrup et al. | 91/420 X |
| 4,165,675 | 8/1979 | Cryder et al. | 91/420 |

FOREIGN PATENT DOCUMENTS

| | | | |
|---|---|---|---|
| 2352742 | 5/1974 | Fed. Rep. of Germany | 91/420 |

*Primary Examiner*—Irwin C. Cohen
*Attorney, Agent, or Firm*—Wegner, Stellman, McCord, Wiles & Wood

[57] ABSTRACT

A high pressure hydraulic system, including a bidirectional fluid motor having two ports, a pair of normally closed, pilot operated poppet valves, each connected to an associated port, a fluid reservoir, a flow sensor having a flow path interconnecting each of the poppet valves and the reservoir and having an output for providing a signal representing the flow rate, along the flow path, a pair of metering valves each connected to the pilot of an associated poppet valve for controlling the flow of fluid through the associated poppet valve, control signal inputs for each of the metering valves, and flow rate signal inputs connected to the output of the flow sensor for each of the metering valves so that each poppet valve is ultimately controlled by both control signals and the flow rate through the flow sensor.

5 Claims, 1 Drawing Figure

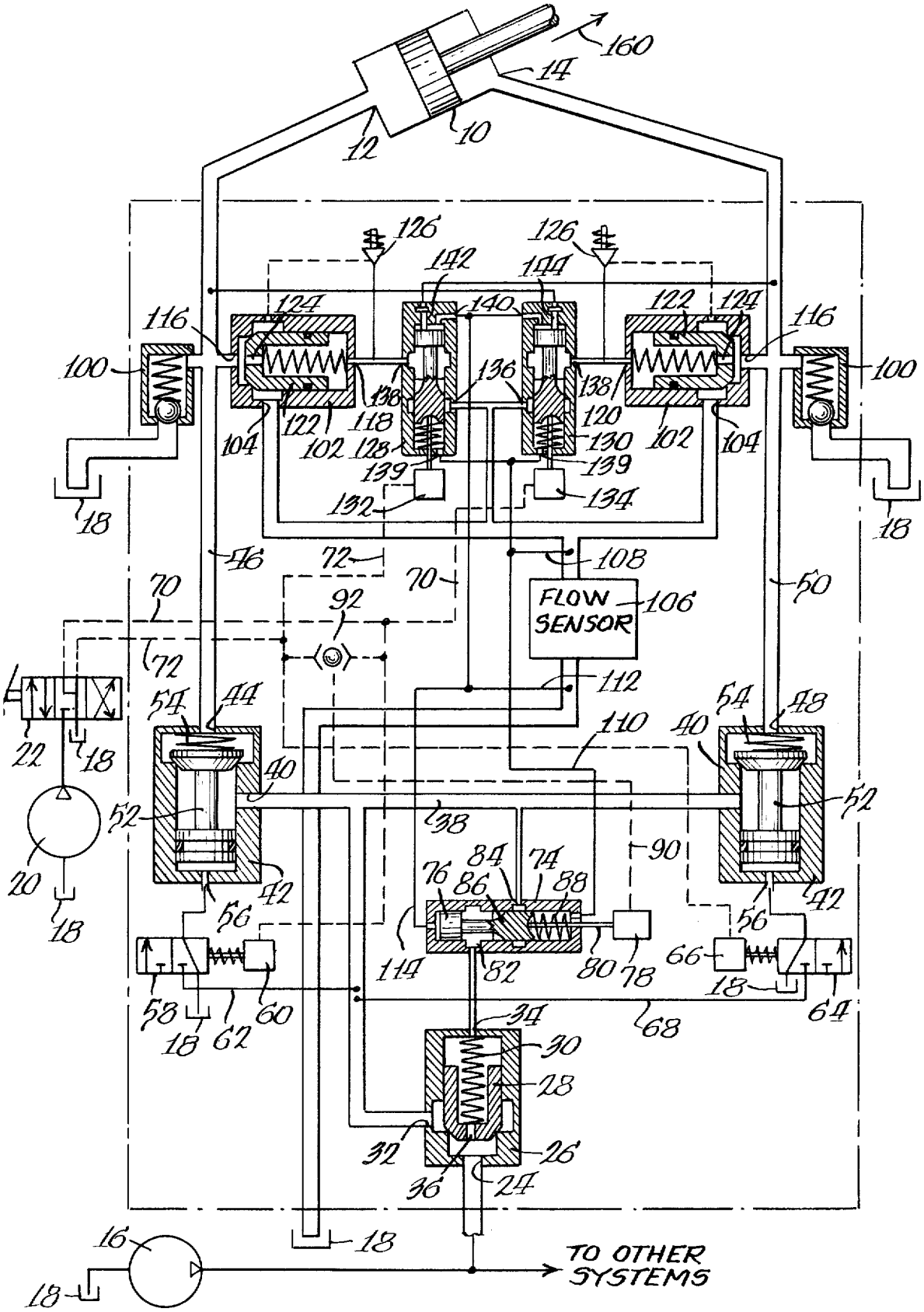
FLOW SENSOR
TO OTHER SYSTEMS

HIGH PRESSURE HYDRAULIC SYSTEM

BACKGROUND OF THE INVENTION

This invention relates to hydraulic systems, and more specifically to directional control valving in high pressure hydraulic systems.

Many differing types of apparatus employ hydraulic systems utilizing directional valves. In most instances, the directional valves are of the spool type with the consequence that when utilized in a system having a relatively large capacity, system pressure must be limited to no more than about 4500 psi due to leakage and structural problems. The flow output of such valves is often affected by the loading on the system in which they are employed and frequently relatively high power hydraulic pilot systems are required to minimize operator effort in effecting system operation through valves or the like.

SUMMARY OF THE INVENTION

The present invention is directed to overcoming one or more of the above problems.

In general, the invention is directed to use in a hydraulic system, including a bidirectional fluid motor having two ports along with a pair of normally closed pilot operated poppet valves each connected to an associated port, along with a fluid reservoir.

According to one aspect of the invention, there is provided a flow sensor having a flow path interconnecting each of the poppet valves and the reservoir and having an output means for providing a signal representing flow rate along the flow path. A pair of metering valves are each connected to the pilot of an associated poppet valve for controlling the flow of fluid through the associated poppet valve and control signal input means are provided for each of the metering valves. Flow rate signal input means are provided for each of the metering valves. Flow rate signal input means are also connected to each of the metering valves so that each poppet valve is ultimately controlled by both control signals and flow rate signals through the flow sensor to provide excellent system control as well as enable the use of poppet valves to provide for high pressure operation.

According to another aspect of the invention, a pair of metering valves are provided, one for each poppet valve, and each having a flow metering path connected to the corresponding pilot of the poppet valve. Control means are provided for the metering valves and pressure responsive means are associated with each metering valve for applying a valve opening force thereto in response to a pressure signal. Means connect each of the responsive means to the motor port with which the corresponding poppet valve is not associated so that when fluid under pressure is in one of the motor ports, the poppet valve associated with the other port will be caused to open to exhaust fluid.

According to still a further facet of the invention, there are provided a pair of check valves, one connected to each port, for allowing fluid flow to the associated port and precluding reverse flow. A further pilot operated poppet valve is connected to both the check valves oppositely of the ports and a pump is provided for directing fluid under pressure to the additional poppet valve. An additional metering valve is provided and is connected to the pilot of the additional poppet valve and has a flow rate signal input means connected to the flow sensor output and control signal input means. Thus, flow through the additional poppet valve is controlled by a control signal and by the flow rate through the flow sensor.

According to still a further, and preferred facet of the invention, a system such as that mentioned in the preceding paragraph is such that the additional poppet valve includes a restricted flow passage connected to the additional metering valve. The check valves are pilot operated and control valves are provided for selectively directing fluid to the pilots of the check valves. Means are provided for connecting the additional metering valve to the control valves.

Other objects and advantages will become apparent from the following specification taken in connection with the accompanying drawings.

DESCRIPTION OF THE DRAWINGS

The FIGURE is a somewhat schematic view of the hydraulic system embodying the invention.

DESCRIPTION OF THE PREFERRED EMBODIMENT

An exemplary embodiment of the hydraulic system made according to the invention is seen in the FIGURE and includes a bidirectional hydraulic motor 10 illustrated in the form of a double acting hydraulic cylinder. However, it is to be understood that the invention is applicable to rotary output hydraulic motors as well.

The motor 10 includes two ports 12 and 14, and the direction of its output will, of course, be dependent upon which of the ports 12 and 14 fluid under pressure is applied to.

The system also includes a main pump 16 which directs fluid under pressure to the components utilized in the control of the motor 10, as well as to other, similar or identical systems. For example, when the system is employed in a work performing vehicle such as an excavator, one system such as illustrated in the FIGURE may be utilized for driving the excavator boom while a similar or identical system may be utilized for driving the stick. Still another system, but with a rotary output hydraulic motor, may be utilized for driving the swing circuit. A variety of other systems may be employed as well as those skilled in the art will readily recognize.

The system also includes a hydraulic fluid reservoir 18 shown at various locations in the FIGURE and in general, but a single reservoir will be utilized, the representation of several reservoirs being utilized to avoid complication of the drawing.

A pilot pump 20 is also provided and directs pilot fluid to a manually operated pilot valve 22 which may be suitably operated direct the cylinder 10 to extend or retract and to dictate the rate of extension or retraction by appropriately metering the flow of fluid from the pilot pump 20. In this connection, however, it is to be understood that electrical or mechanical counter-parts may be utilized in lieu of the pilot pump 20 and control valve 22. It should also be understood that the valve 22, or counterparts thereof, may be machine actuated rather than manually actuated.

The discharge of the pump 16 is directed to the inlet 24 of a poppet valve 26. The poppet valve 26 includes a poppet 28 which is biased towards a closed position by a spring 30. In addition, the poppet valve 26 includes an outlet 32, as well as pilot port 34. A restricted fluid flow passage 36 extends through the poppet 28 to establish fluid communication between the inlet 24 and pilot 34, and, as can be seen in the FIGURE the effective area of the poppet 28 facing the inlet 24 is less than that facing the pilot port 34. As a consequence of this construction, when fluid flow from the pilot port 34 is precluded, equal pressure will be present on both sides of the poppet 28 such that the same will assume a closed condition precluding fluid flow from the inlet 24 to the outlet 32. Conversely, should fluid flow from the port 34 be allowed to take place, fluid will flow through the restricted passage 36 causing a pressure drop across the poppet 28 so that, depending upon precise size of the effective areas on both sides of the poppet 28, the force of the spring 30 and the flow rate through the pilot port 34, the poppet 28 will open to allow fluid flow in varying degrees.

The outlet 32 of the poppet valve 26 is connected by a conduit 38 to the inlet ports 40 of a pair of pilot operated check valves 42. The outlet 44 of the left-hand check valve 42 is connected by a conduit 46 to the port 12 of the fluid motor 10 while the outlet 48 of the right-hand check valve 42 is connected via a conduit 50 to the port 14 of the fluid motor 10.

Each of the check valves 42 includes a pilot operated poppet 52 which is normally spring biased by a spring 54 to a closed position. Each check valve further includes a pilot port 56 which, when fluid under pressure is applied thereto, will cause the associated poppet 52 to shift to an open position.

The pilot port 56 of the left-hand check valve may receive fluid under pressure via a valve 58 having an actuator 60 through a line 62 connected to the conduit 38, while the right-hand check valve may have its pilot 56 pressurized by a valve 64 having an actuator 66 and connected via a line 68 to the conduit 38.

As a consequence of the foregoing construction, when the poppet valve 26 opens, and either the valve 58 or the valve 64 opens, the corresponding check valve 42 will be open to direct fluid under pressure to a corresponding one of the ports 12 or 14 to extend or retract the cylinder 10.

The actuators 60 and 66 for the valves 58 and 64 are hydraulically operated although they could be electrically or mechanically operated as mentioned previously. The actuators 60 and 66 are respectively connected by a line 70 or 72 to the pilot valve 22 so that the two cannot be actuated simultaneously. As can be seen, depending upon the positioning of the valve 22, one of the actuators 60 or 66 can be provided with pilot pressure from the pump 20, while the other is connected to the reservoir or, in the alternative, both may be connected to the reservoir 18 when the valve 22 is in the position illustrated.

A metering valve 74 includes a spool 76 and is provided with an actuator 78 mechanically linked by a link 80 to the spool 76. The valve 74 includes axially spaced ports 82 and 84 with the port 82 being connected to the pilot port 34 of the poppet valve 26. The spool 76 includes a land 86 provided with metering slots whereby the rate of fluid flow between the ports 82 and 84 may be selectively controlled or terminated altogether. The actuator 78 is of the proportional type and is operative to shift the spool 76 to the right as viewed in the FIGURE against the bias of a spring 88, the degree of such shifting being proportional to the magnitude of a hydraulic signal applied to the actuator 78 on a line 90.

The port 84 is connected to the conduit 38 while the line 90 is connected to the output of a resolver 92, connected between the lines 70 and 72. As a consequence, whenever the pilot valve 22 has been shifted to pressurize either the line 70 or 72, a pressure signal having a magnitude dependent upon the degree of shifting of the valve 22, will be applied to the actuator 78 to cause the same to open the valve 74. When such occurs, a relief path for fluid from the pilot port 34 of the poppet valve 26 will be established allowing popper 28 to open when the flow is such that the requisite pressure drop is attained. It will be observed that this circuit provides fluid to the pilot 56 of one or the other of the check valves 42 dependent upon which valve 58 or 64 is open, via the path from the port 84 to the conduit 38 to either the line 62 or the line 68 notwithstanding the fact that the poppet 28 will be initially closed at this time.

Each of the conduits 46 and 50 includes a junction to a respective make-up valve 100 which in turn is connected to the reservoir 18 for the usual purpose of providing make-up fluid to prevent cavitation in the event of a negative load situation. Also connected through the conduits 46 and 50 are respective, pilot operated, normally closed poppet valves 102, each having outlets 104, connected via a conventional flow sensor 106 to the reservoir 18. A tap 108 between the flow sensor 106 and the valves 102 is connected via a line 110 to the metering valve 74 so that the pressure at the tap 108 is applied against the right hand end of the spool 76 to tend to urge the same towards a closed position in bucking relation to any opening force applied by the actuator 78. A tap 112 on the reservoir side of the flow sensor 106 is connected via a line 114 to the metering valve 74 to direct pressure against the left hand end of the spool 76 so as to provide a pressure force against the spool 76 acting in concert with any opening force applied by the actuator 78.

As is well known, the flow sensor 106 is, in essence, a variable orifice and the greater the flow through the flow sensor 106, the greater the pressure differential across the same, which pressure differential will be present across the taps 108 and 112. For a lesser flow, the pressure differential will be less.

Returning to the valves 102, the same have inlets 116 connectd respectively to the lines 46 and 50 with the left hand valve 102 having a pilot port 118 and the right hand valve 102 having a pilot port 120. The valves 102 each include a poppet 122 which is spring biased towards a closed position and, like the poppet valve 26, it will be appreciated that the effective area of each poppet 122 facing the inlet 116 is less than the effective area facing the associated pilot port 118 or 120. Like the poppet 28, each poppet 122 is further provided with a restricted fluid flow passage 124 establishing fluid communication between the inlet 116 and the corresponding pilot port 118 or 120.

Conventional pressure relief circuits 126 innerconnect the outlet ports 104 and the pilot ports 118 and 120 of the valves 102.

Control over the fluid flow through each of the valves 102, is provided by corresponding metering valves 128 and 130, the metering valve 128 being associated with the left hand valve 102 and the metering valve 130 being associated with the right hand valve 102.

The valves 128 and 130 are generally similar to the valve 74 and accordingly only the differences will be discussed. Each is provided with an actuator 132 and 134, respectively, connected to the line 72 and 70 respectively to receive pilot fluid from the valve 22 dependent upon the setting thereof. Each further includes an outlet port 136 connected to the flow sensor 106 as well as an inlet port 138 connected to the pilot port 118 or 120 of the associated valve 102.

Each valve 128 and 130 further includes an inlet 139 whereby pressure at the tap 108 may be applied against the corresponding spool to urge the same towards a closed position in opposition to any opening force applied by the associated actuator 132 or 134, as well as a port 140 connected to the tap 112 to apply pressure at the tap 112 to the spool in bucking relation to the pressure applied from the tap 108.

In addition, each valve 128 and 130 includes a piston 142 and 144 which may abut the spool to urge the associated valve 128 or 130 towards an open position when pressurized. The piston 142 of the valve 128 is connected to the line 50, while the piston 144 of the valve 130 is connected to the line 46. In other words, the pistons 142 and 144 are cross-connected to the port 12 or 14 of the motor 10 with which the associated poppet valve 102 is not associated.

As a consequence of this construction, when one or the other of the valves 128 and 130 opens, it establishes a flow path from the piston port 118 or 120 of the associated poppet valve 102 with the result that a pressure drop occurs across the associated poppet 122. When the pressure drop reaches a predetermined value, the corresponding poppet 122 will open to allow fluid from the corresponding port 12 or 14 of the hydraulic cylinder 10 to flow therefrom through the flow sensor 106 to the reservoir 118.

Operation of the system and a description of the various features provided by it are as follows. Since the operation is identical whether the cylinder 10 is instructed to extend or retract, differing only in which of the valves 42, the valves 58 or 64, the valves 102 and the valves 128 or 130 provide control functions, only one condition will be described.

If it be assumed that the valve 22 be shifted to apply pilot pressure at some magnitude to the line 70 to command the rod of the cylinder 10 to move in the direction of an arrow 160, the following happenings will occur. The pressure in the line 70 will cause the actuator 60 to open the valve 58. Simultaneously, the actuator 78 will be energized to shift the spool 76 to the right. The degree of such shifting will be proportional to the pressure applied to the actuator 78.

As a result, a flow path from the pilot port 34 of the poppet valve 26 will be established to provide fluid to the line 62 from the conduit 38, through the valve 58, to the pilot port 56 of the check valve 42 to open the same. At the same time, the flow of fluid from the pilot port 34 will establish a pressure drop across the poppet 28 allowing the same to open to some desired degree, dependent upon the actual pressure drop involved.

Fluid under pressure from the pump 16 will then flow through the poppet valve 26 and the check valve 42 to the port 12 of the cylinder 10 to cause the rod to move in the direction of the arrow 160.

At the same time, the pressurized fluid in the conduit 46 will be applied against the piston 144 of the valve 130 causing the same to open, thereby establishing a path for fluid flow from the pilot port 120 of the right hand check valve 102 to drain. This will result in a pressure drop occurring across the poppet 120 of the right hand poppet valve 104. A pressure drop will exist because the application of pressure to the piston at the cylinder 10 of the port 12 will result in a pressure increase in the line 50. The poppet valve 122 will then open allowing fluid from the port 104 to be discharged to the reservoir 18 via the flow sensor 106.

Should the flow across the sensor 106 exceed some predetermined level as, for example, during a negative or an over-running load condition, the pressure differential across the taps 108 and 112 will begin to grow with the consequence that the spool 76 of the valve 74 will be shifted towards a more closed position. As a result, less fluid will flow from the pilot port 34 of the poppet valve 26 with the consequence that a lesser pressure drop will exist and the poppet 28 will begin to close, throttling flow from the pump 16 to the port 12. At the same time, if the negative or over-running load condition occurs, it will be appreciated that the pressure at the port 12 will begin to decrease with the result that the opening force applied to the piston 144 of the valve 130 will begin to decrease and the increasing pressure differential at the taps 108 and 112 applied to the piston 144 will cause the same to begin to close. This in turn will result in the poppet 122 shifting towards a closed position to throttle exhaust flow from the port 14.

Conversely, should flow across the sensor 106 decrease from a desired amount the resulting decrease in the pressure differential at the taps 108 and 112 will cause, ultimately, both the poppet valve 26 and the right hand poppet valve 102 to open to a greater extent allowing increased flow.

Thus, it will be appreciated that excellent flow rate control characteristics are provided by the system.

Moreover, it will be appreciated that spool valves are not at all involved in connection with the main pump 16. Rather, low leakage poppet valves are employed thereby allowing a substantial increase in the maximum system pressure usable.

The fact that poppet valves are employed further minimizes drift conditions due to their lower leakage and it will be appreciated by those skilled in the art that the system includes control input versatility in terms of allowing low power hydraulic pilot control, electrical operation, or even mechanical operation if desired.

The embodiments of the invention in which an exclusive property or privilege is claimed are defined as follows:

1. A hydraulic system comprising:

a fluid reservoir;

a bidirectional fluid motor having two ports;

a pair of normally closed, pilot operated poppet valves, each connected to an associated port and to said fluid reservoir;

a flow sensor having a flow path interconnecting each of said poppet valves and said reservoir having output means for providing a signal representing flow rate along said flow path;

a pair of metering valves each connected to the pilot of an associated poppet valve for controlling the flow of fluid through the associated poppet valve;

control signal input means for each of said metering valves;

flow rate signal input means connected to said flow sensor and to each of said metering valves for delivery of a flow rate signal from said flow sensor to each of said metering valves;

wherein each poppet valve is ultimately controlled by both control signals and the flow rate through said flow sensor;

each of said metering valves further including pressure signal input means responsive to a hydraulic signal having an elevated pressure for opening the associated poppet valve; and means cross-connecting said pressure signal input means to the port with which the corresponding poppet valve is not associated.

2. A hydraulic system comprising:

a fluid reservoir;

a bidirectional fluid motor having two ports;

a pair of normally closed, pilot operated poppet valves, each connected to an associated port and to said fluid reservoir;

a flow sensor having a flow path inteconnecting each of said poppet valves and said reservoir having output means for providing a signal representing flow rate along said flow path;

a pair of metering valves each connected to the pilot of an associated poppet valve for controlling the flow of fluid through the associated poppet valve;

control signal input means for delivering a control signal to each of said metering valves;

flow rate signal input means connected to said flow sensor and to each of said metering valves for delivery of a flow rate signal from said flow sensor to each of said metering valves;

whereby each poppet valve is ultimately controlled by both control signals and the flow rate through said flow sensor;

a pair of check valves, one connected to each port, for allowing fluid flow to the associated port and precluding reverse flow;

an additional pilot-operated poppet valve connected to both said check valves oppositely of said ports;

an additional metering valve connected to the pilot of said additional poppet valve and to said flow sensor output means;

means responsive to said flow rate signal to operate said additional metering valve; and a pump for directing fluid under pressure to said additional poppet valve.

3. The hydraulic system of claim 2, wherein said additional poppet valve includes a restricted flow passage connected to said additional metering valve and wherein said check valves are pilot operated; control valves for selectively directing fluid to the pilots of said check valves, and means connecting said additional metering valve to said control valves.

4. A hydraulic system comprising:

a fluid reservoir;

a bidirectional fluid motor having two ports;

a pair of normally closed, pilot-operated poppet valves, each connected to an associated port and to said fluid reservoir;

a flow sensor having a flow path interconnecting each of said poppet valves and said reservoir having output means for providing a signal representing flow rate along said flow path;

a pair of metering valves each connected to the pilot of an associated poppet valve for controlling the flow of fluid through the associated poppet valve;

control signal input means for each of said metering valves;

a pair of check valves, one connected to each port, for allowing fluid flow to the associated port and precluding reverse flow;

a further pilot-operated poppet valve connected to both said check valves oppositely of said ports;

a pump for directing fluid under pressure to said additional poppet valve;

an additional metering valve connected to the pilot of said additional poppet valve and having flow rate signal input means connected to said flow sensor output and control signal input means; and, means responsive to said flow rate signal input means to operate said additional metering valve whereby flow through said additional poppet valve is controlled by a control signal and by the flow rate through said flow sensor.

5. The hydraulic system of claim 4, wherein said additional poppet valve includes a restricted flow passage connected to said additional metering valve and wherein said check valves are pilot operated; control valves for selectively directing fluid to the pilots of said check valves, and means connecting said additional metering valve to said control valves.

* * * * *